US006182646B1

(12) United States Patent
Silberstein et al.

(10) Patent No.: US 6,182,646 B1
(45) Date of Patent: Feb. 6, 2001

(54) ELECTROMECHANICALLY ACTUATED SOLENOID EXHAUST GAS RECIRCULATION VALVE

(75) Inventors: David Ehud Silberstein, Southfield; Giuseppe Ganio Mego, Royal Oak; John C. Green, Sterling Heights; Robert Meilinger, Beverly Hills, all of MI (US)

(73) Assignee: BorgWarner Inc., Troy, MI (US)

( * ) Notice: Under 35 U.S.C. 154(b), the term of this patent shall be extended for 0 days.

(21) Appl. No.: 09/266,650

(22) Filed: Mar. 11, 1999

(51) Int. Cl.[7] ..... F02M 25/07

(52) U.S. Cl. ..... 123/568.26; 251/129.15

(58) Field of Search ..... 123/568.26, 568.21; 251/129.15, 129.18; 335/219, 262, 261, 260, 278, 279

(56) References Cited

U.S. PATENT DOCUMENTS

| | | | | |
|---|---|---|---|---|
| 4,378,777 | | 4/1983 | Iida . | |
| 4,662,604 | | 5/1987 | Cook . | |
| 4,796,854 | | 1/1989 | Ewing . | |
| 4,858,886 | | 8/1989 | Tatara . | |
| 5,027,781 | * | 7/1991 | Lewis | 123/568.21 |
| 5,188,073 | * | 2/1993 | Ejiri et al. | 123/339 |
| 5,255,659 | | 10/1993 | Choma . | |
| 5,435,519 | * | 7/1995 | Everingham | 251/129.15 |
| 5,460,146 | * | 10/1995 | Frankenberg | 123/568.26 |
| 5,467,962 | * | 11/1995 | Bircann et al. | 251/129.15 |
| 5,494,255 | * | 2/1996 | Pearson et al. | 251/129.15 |
| 5,577,484 | | 11/1996 | Izutani . | |
| 5,901,940 | * | 5/1999 | Hussey et al. | 123/568.26 |
| 5,911,401 | * | 6/1999 | Hrytzak et al. | 251/129.15 |
| 5,957,117 | * | 9/1999 | Everingham | 123/568.26 |
| 5,960,776 | * | 10/1999 | Everingham et al. | 123/568.26 |
| 5,975,064 | * | 11/1999 | Krimmer et al. | 123/568.18 |
| 5,988,147 | * | 11/1999 | Everingham | 123/568 |
| 6,053,473 | * | 4/2000 | Shinobu et al. | 251/129.19 |

* cited by examiner

*Primary Examiner*—Henry C. Yuen
*Assistant Examiner*—Arnold Castro
(74) *Attorney, Agent, or Firm*—Artz & Artz P.C.; Greg Dziegielewski

(57) ABSTRACT

A closed-loop controlled system solenoid actuated EGR valve includes an engine mount for attachment to a vehicle engine, a valve housing to which the engine mount is attached, a motor housing positioned above the valve housing, and a sensor housing. The valve housing includes a valve inlet adapted to receive engine exhaust gas and a valve outlet which communicates the engine exhaust gas from the valve inlet to an engine intake system. The motor housing has a bobbin, an armature, and a valve stem disposed in a bore formed therein. The valve stem is in communication with a plunger extending from the sensor housing to monitor the position of the valve stem with respect to the valve seat. A guide bearing is positioned in the housing to guide the armature while a valve stem bearing is positioned in the valve housing to contact and position the valve stem with respect to the valve seat while a valve opening is being closed.

41 Claims, 5 Drawing Sheets

ELECTROMECHANICALLY ACTUATED SOLENOID EXHAUST GAS RECIRCULATION VALVE

TECHNICAL FIELD

The present invention relates generally to an exhaust gas recirculation valve. More specifically, the present invention relates to an electromechanically actuated exhaust gas recirculation valve for a vehicle engine that provides high performance at low cost and also assists in decreasing harmful emissions.

BACKGROUND OF THE PRESENT INVENTION

Exhaust gas recirculation ("EGR") valves form an integral part of the exhaust gas emissions control in typical internal combustion engines. EGR valves are utilized to recirculate a predetermined amount of exhaust gas back to the intake system of the engine. The amount of exhaust gas permitted to flow back to the intake system is usually controlled in an open-looped fashion by controlling the flow area of the valve, i.e., the amount of exhaust gas that is permitted to flow through the valve. Such open-loop control makes it difficult to accurately control the exhaust gas flow through the valve over the valve's useful life. This is because the valve has various components that can wear or because vacuum signals which are communicated to such valves will vary or fluctuate over time resulting in the potential contamination of various valve components which could affect the operation of the valve.

Many EGR valves utilize a moveable diaphragm to open and close the valves. However, these valves can lack precision because of the loss of vacuum due to external leak-paths. To overcome the lack of consistently available vacuum to control a movable diaphragm, electrically actuated solenoids have been used to replace the vacuum actuated diaphragm. Moreover, typical vacuum actuated valves can also have problems with accuracy due to their inability to quickly respond based on changes in engine operating conditions. Further, current EGR valves typically have an inwardly opening valve closure element that is moved into its valve housing relative to a cooperating valve seat in order to open the valve. Over the useful life of these valves, carbon can accumulate on the valve closure element and upon its valve seat, thereby preventing the valve from completely closing. The valve closure elements are also positioned within the housing or body of these EGR valves and because it is virtually impossible to clean the valve closure element and the valve seat, contamination thereby necessitates replacement of these integral pollution system components.

Additionally, exhaust gas recirculation valves that require a high force to open the valve, operate through pressure balancing, whether through a diaphragm or other balancing members. Alternatively, too low a force can open the valve allowing exhaust gas to flow through the valve opening when such exhaust gas is not needed. By allowing exhaust gas to act as part of the pressure balance, it necessarily contacts the internal moving parts of the valve causing contaminants to accumulate thereon which can interfere with the proper operation of the valve, as discussed above.

SUMMARY OF THE INVENTION

It is, therefore, an object of the present invention to provide an improved electromechanically actuated EGR valve that is used to meter and control the passage of exhaust gases from an exhaust passage to the intake system of an internal combustion engine.

It is another object of the present invention to provide an electromechanically actuated EGR valve that helps reduce an engine's emissions of environmentally unfriendly elements.

It is yet another object of the present invention to provide an electromechanically actuated EGR valve that helps decrease environmentally unfriendly emissions.

It is a further object of the present invention to provide an EGR valve that has no external leak path and is, therefore, sealed from the atmosphere.

It is still a further object of the present invention to provide an EGR valve that has closed-loop control of the movement of the valve stem and the opening and closing of the valve.

In accordance with the above and other objects of the present invention, a solenoid actuated EGR valve for an engine is disclosed. The EGR valve includes a valve housing, a motor housing, and an engine mount for attaching the EGR valve to the engine. The valve housing includes a valve inlet adapted to receive exhaust gas and a valve outlet adapted to communicate the received exhaust gas to the intake manifold of the engine. The motor housing is positioned above the valve housing and has an electromagnetic mechanism disposed therein, which includes a plurality of wire windings, a bobbin, an armature, and a valve stem in communication with the armature. The armature is moved due to increased current that creates electromagnetic forces created in the magnetic circuit which moves the valve stem with respect to a valve seat that is located in the valve housing around the periphery of a valve opening. A plunger extends from a sensor housing positioned above the motor housing to monitor the position of the valve stem. A guide bearing is disposed within the motor housing and is in communication with the armature to help position the armature concentrically within the magnetic circuit. A valve stem bearing is also positioned within the valve housing to assist in insuring proper closure of the valve in the valve seat as the armature is moving downwardly.

These and other features and advantages of the present invention will become apparent from the following descriptions of the invention, when viewed in accordance with the accompanying drawings and appended claims.

BEST MODE(S) FOR CARRYING OUT THE INVENTION

Figure 1:
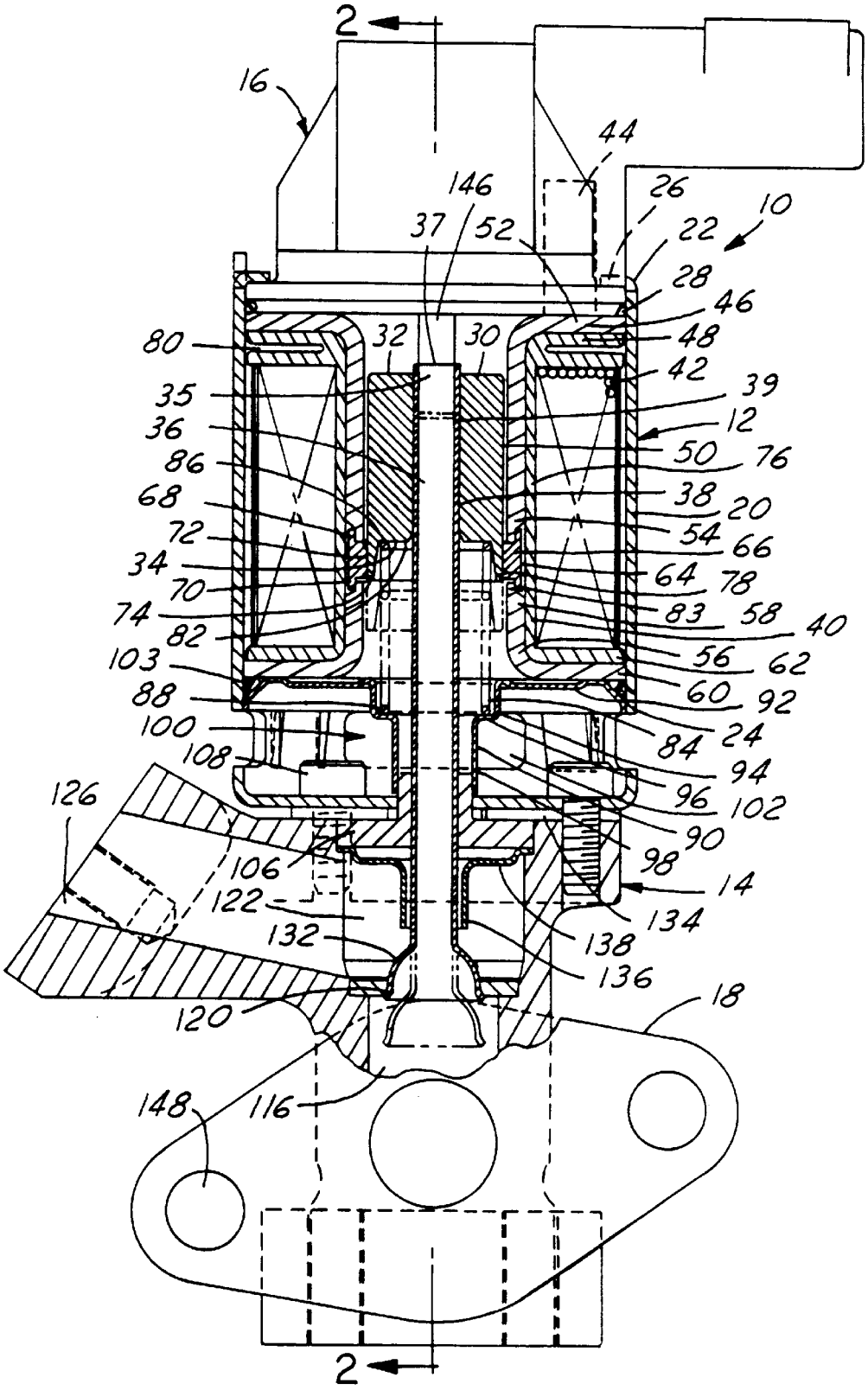
FIG. 1 is a cross-sectional view of an exhaust gas recirculation valve, including an engine mount, in a closed position in accordance with a preferred embodiment of the present invention.
Figure 2:
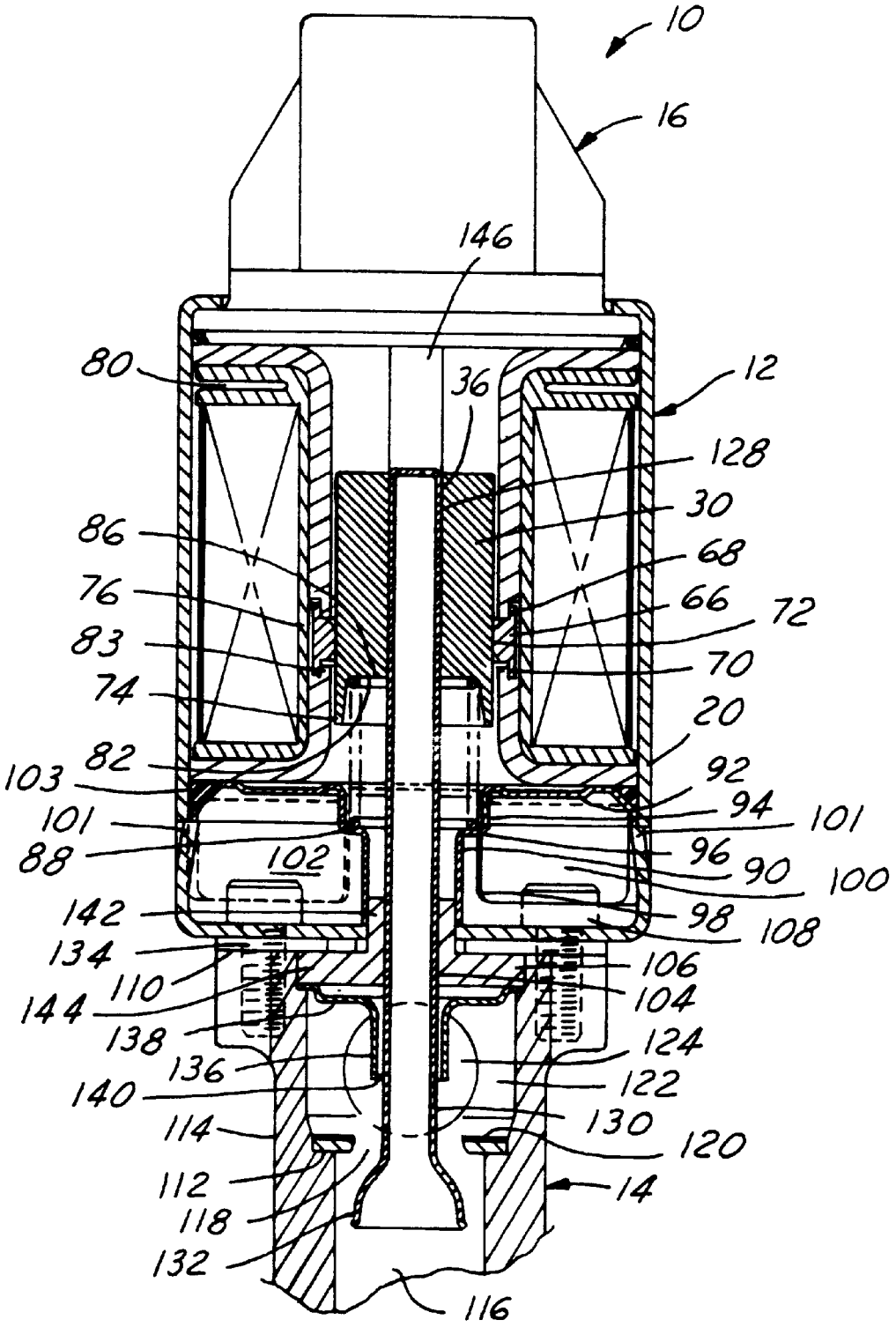
FIG. 2 is a cross-sectional view of the exhaust gas recirculation valve of FIG. 1, along the line 2—2 with the valve in an open position.

FIGS. 1 and 2 illustrate an exhaust gas recirculation ("EGR") valve 10 in accordance with a preferred embodiment of the present invention. The valve 10 is a solenoid actuated ERG valve, having a motor housing 12, a valve housing 14, a sensor housing 16, and an engine mount 18.

The motor housing 12 includes an outer shell 20 having a top portion 22 and a bottom portion 24. The motor housing 12 is preferably comprised of steel, however, any other suitable magnetic material can be utilized. The top portion 22 of the outer shell 20 has an upper peripheral portion 26 that is bent or otherwise formed so as to extend generally inwardly to crimp the sensor housing 16 to the motor housing 12. An upper seal 28, such as an O-ring or the like, is preferably positioned at the peripheral connection of the sensor housing 16 and the motor housing 12 to seal the motor housing 12 from the atmosphere and eliminate any leak paths. As shown, the upper seal 28 seals three surfaces from external leaks. Additionally, the upper seal 28 will expand upon increased heat, which will minimize any rattle in the valve 10 and provide improved vibration characteristics.

An armature 30 is disposed within the motor housing 12 and has a top surface 32 and a bottom surface 34. The armature 30 preferably has a nickel plated surface to provide hardness, durability, and low friction. The armature 30 may also have other coatings that provide similar characteristics, such as chrome. The armature 30 preferably has a hollow pintel valve 35 positioned within a bore 38 formed in the center of the armature 30. The hollow pintel valve configuration allows for the low transmission of heat to the coil and armature and also improves gas flow, such as when in the position shown in FIG. 3. The valve stem 36 has a closed upper end 37 that is secured within the bore 38 and may extend above the top surface 32 of the armature 30. The hollow valve 36 may be attached to the bore 38 in any of a variety of ways. Moreover, the closed upper end 37 of the hollow valve 36 may also be positioned such that its top surface terminates below the top surface 32 of the armature 30. A valve stem 36, which is preferably also hollow to reduce the weight of the part is preferably press fit into the bore 38 formed in the center of the armature 30. This configuration allows the effective length of the valve stem 36 to be changed by how far it is inserted into the armature bore 38, as is discussed in more detail below. The connection or assembly of the valve stem 36 is less costly and provides a more accurately formed valve as the length of the valve stem is not dependent upon precise tolerances as any excess length valve stem 36 can be accommodated for by the armature bore 38.

A bobbin 40 holds a plurality of wire windings 42 in the motor housing 12. The bobbin 40 encapsulates the armature 30 and valve stem 36. The wire windings 42 are excited by current from a contact or terminal 44 that is positioned within the sensor housing 16 and in communication with the wire windings 42 by a wire 45 or the like. The increased current in the windings 42 is used to move the armature 30 downwardly within the motor housing 12, thus moving the valve stem 36 correspondingly downward.

A flux return 46, which is preferably comprised of a magnetic material, is positioned between the upper portion 48 of the bobbin 40 and the outer periphery 50 of the armature 30. The flux return 46 has an upper portion 52 and a lower portion 54. A pole piece 56, having a first portion 58 and a second portion 60, is anularly positioned between the lower portion 62 of the bobbin 40 and the valve stem 36 and axially below the flux return 46. A gap 64 is preferably formed between the first portion 58 of the pole piece 56 and the lower portion 54 of the flux return 46.

An armature bearing 66 is disposed in the motor housing 12 to guide the armature 30 as it travels in response to increased and decreased current in the wire windings 42. The armature bearing 66 is positioned in the gap 64 and has an upper shoulder portion 68 and a lower shoulder portion 70. The upper shoulder portion 68 is overlapped by the lower portion 54 of the flux return 46 while the lower shoulder portion 70 of the armature bearing 66 is overlapped by the first portion 58 of the pole piece 56 such that the armature bearing 66 is securely positioned within the motor housing 12. The armature bearing 66 also has an annular surface 72 which contacts the outer periphery 50 of the armature 30 to guide the armature 30 as it moves linearly within the motor housing 12. The armature bearing 66 also assists in keeping the armature 30 and thus the valve stem 36 accurately and centrally positioned within the motor housing 12. Further, the armature bearing 66 helps keep the pole piece 56 and the flux return 46 concentrically positioned. The armature bearing 66 is preferably bronze, however, any other suitable materials can be utilized. The armature bearing 66 is thus positioned within a magnetic flux path created between the pole piece 56 and the flux return 46.

The bobbin 40 is bounded at its upper portion 48 by the upper portion 52 of the flux return 46. The bobbin 40 is bounded at its middle portion 76 by the lower portion 54 of the flux return 46 and the first portion 58 of the pole piece 56. The bobbin 40 is bounded and at its lower portion 62, by the second portion 60 of the pole piece 56. The bobbin 40 thus separates the inner surfaces of the pole piece 56 and the flux return 46 from the wire windings 42. The bobbin 40 has a groove 80 formed in its upper portion 48 for securely holding the wire 45 to the terminal 44 to provide constant electrical contact between the wire windings 42 and the sensor housing 16 and to allow for the energizing of the wire windings 42.

The armature 30 has a cavity 82 formed in the armature bottom surface 34 which is defined by an armature ear 74 that extends around the periphery of the cavity 82 and contacts the armature bearing 66. The ear 74 is preferably positioned on the armature 30 as opposed to being positioned on the pole piece 56 for controlling the flux path as has been previously done. The armature 30 is positioned within the motor housing 12 such that when the valve is closed, the lowermost portion 78 of the armature ear 74 is aligned in the same plane as the top of the pole piece 56. The configuration of the flux return 46 and the pole piece 56 is such that the inclusion of the gap 64 therebetween minimizes the net radial magnetic forces, by limiting the radial forces on the armature 30 and thus the side loading on the armature bearing 66. The geometry of the armature 30 also provides radial and axial alignment. Additionally, by initially aligning the armature ear 74 with the top of the pole piece 56, the magnetic flux in the motor housing is limited which allows for larger tolerances which in turn decreases the cost to manufacture the valve 10. Additionally, by aligning the initial position of the armature 30 with the top 83 of the pole piece 56, the movement of the armature 30 is limited to its useable range such that the valve 10 may be more accurately controlled.

A biasing spring 84 having an upper surface 86 and a lower surface 88 is disposed within the motor housing 12. The upper surface 86 of the biasing spring 84 is disposed within the cavity 82 and contacts the armature bottom surface 34. The lower surface 88 of the biasing spring 84 contacts a partition member 90 and is supported thereon. The partition member 90 has an upper surface 92, a stepped portion 94, with a shoulder portion 96, and an annular surface 98. The upper surface 92 preferably runs generally parallel with and contacts the second portion 60 of the pole piece 56 to provide support thereto. The lower surface 88 of the biasing spring 84 rests on the shoulder portion 96 of the partition member 90 while the annular surface 98 extends generally downward from the shoulder portion 96 towards the bottom portion 24 of the housing outer shell 20. The biasing spring 84 acts to urge the armature 30 to its initial position, shown in FIG. 1, where the valve 10 is closed. When the valve 10 is opened, due to downward movement of the armature 10, the biasing spring 84 is compressed, as shown in FIG. 2.

An annular cavity 100 is formed in the motor housing 12 and is defined by the partition member 90, the housing outer shell 20, and the bottom portion 24 of the housing outer shell 20. A plurality of vent openings 102 are formed in the housing outer shell 20 of the valve 10 to allow cool air to circulate through the annular cavity 74 to cool the valve stem 36 and other components in the motor housing 12. This arrangement also provides an air gap between the motor housing 12 and the valve housing 14 that will limit the egress of heat from the valve housing 14 to the motor housing 12. The annular cavity 100 may be formed between the motor housing 12 and valve housing 14 with vent openings 102 communicating therewith.

A lower seal 103 is provided at the juncture between the upper surface 92 of the partition member 90, the housing outer shell 20, and the second portion 60 of the pole piece 56 to eliminate any leak path between the annular cavity 100 and the motor housing 12. The lower seal 103 also seals three surfaces from external leaks and provides improved vibration characteristics when the lower seal 103 expands. The lower portion 24 of the can 20 has a plurality of shear tabs 101 formed therein. The shear tabs 101 extend generally inwardly into the annular cavity 100 and support the partition member 90. These shear tabs 101 can be formed in subsequent manufacturing processes allowing for inexpensive one-piece manufacturing of the can 20 without the need for additional material to support the partition member 90. The configuration allows for the inexpensive support of the wire windings 42 and also provides a spring against which the motor housing 12 can be crimped.

The bottom portion 24 of the housing outer shell 20 has a valve stem opening 104 formed therethrough. The valve stem opening 104 is formed in the bottom portion 24 of the outer shell 20 such that the valve stem 36 can pass between the annular surface 98 of the partition member 90. A valve stem bearing 106 is preferably positioned within the valve stem opening 104 and extends into the valve housing 14. The valve stem bearing 106 contacts the valve stem 36 when the valve stem 36 is moving upwardly and downwardly within the motor housing 12 to ensure accurate positioning of a valve poppet 132 in a valve seat 120.

The valve housing 14 is preferably positioned beneath the motor housing 12 and is secured thereto by a plurality of fasteners 108, such as bolts or the like, which are passed through the bottom portion 24 of the outer shell 20 and into the valve housing 14. The valve housing 14 includes a top surface 110, in communication with the motor housing 12, a bottom surface 112 in communication with an engine manifold, and an outer periphery 114. A gasket 134 is preferably positioned between the bottom portion 24 of the outer shell 20 and the valve housing 12 to reduce valve noise and vibration. The inclusion of the gasket 134 prevents any metal of the motor housing 12 from contacting any metal from the valve housing 14 and hinders the conductivity of heat and vibration. The only metal to metal contact between the motor housing 12 and the valve housing 14 is through the plurality of fasteners 108 that attach the motor housing 12 to the valve housing 14. The valve housing 14 includes an inlet passage 116, a valve opening 118 surrounded by the valve seat 120, a gas chamber 122, an exhaust opening 124, and an exhaust passage 126.

The valve stem 36 has an upper portion 128 that is partially telescopically received within the armature 30, and a lower portion 130 positioned within the valve housing 14. The lower portion 130 of the valve stem 36 has the poppet 132 formed thereon, for communication with the valve seat 120. The valve stem 36 is secured in the armature 30, through the valve stem opening 104 formed in the bottom portion 24 of the housing 20 and into contact with the valve seat 120. The valve stem bearing 106 is preferably positioned within the valve stem opening 104 and helps to accurately position the valve stem 36 and thus the poppet 132 with respect to the valve seat 120 as the valve opening 118 is being opened and closed. When the valve stem 36 is in a fully closed position or is being opened, the valve stem 36 contacts the valve stem bearing 106 to ensure accurate positioning thereof. The valve housing 14 is preferably formed of a metal casting. However, any other suitable material or manufacturing method may be utilized.

Figure 3:
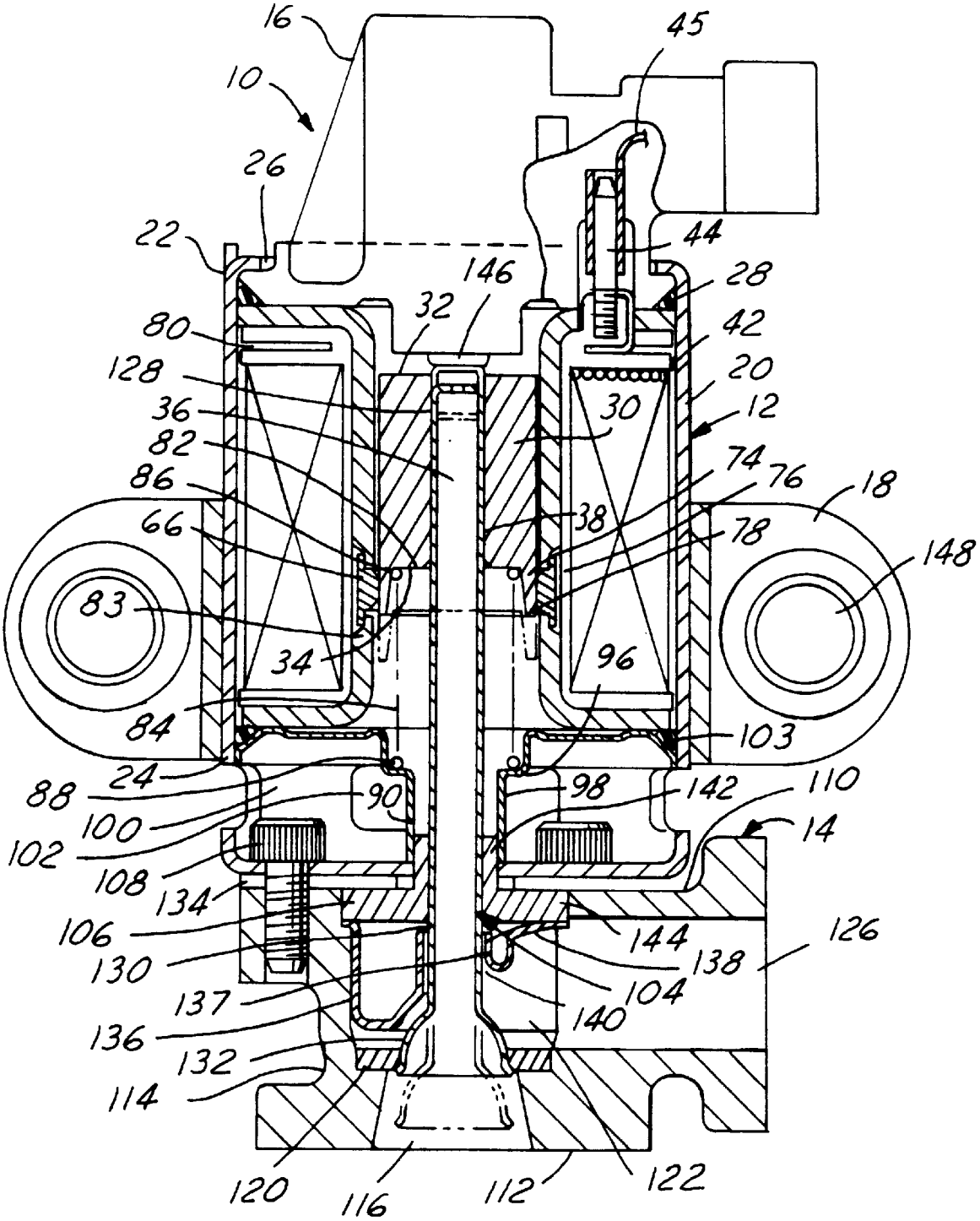
FIG. 3 is a cross-sectional view of an exhaust gas recirculation valve, including an engine mount, in accordance with another preferred embodiment of the present invention.

A stem shield 136 is preferably positioned within the valve housing 14. The stem shield 136 has a shoulder portion 138 that is preferably wedged between the valve stem bearing 106 and the valve housing 14. The stem shield 136 has a passageway 140 formed therethrough for passage of the valve stem 36. The stem shield 136 prevents contaminants in the exhaust gas that enter the gas chamber 122 through the inlet passage 116 from passing upward into communication with the valve stem bearing 106. The stem shield 136 may take on a variety of different configurations, depending upon the flow path of the valve, such as shown in FIGS. 1 and 3. For example, the stem shield 136 can guide the flow of exhaust gas through the valve, can improve its flow, can increase its flow and/or can direct the flow in a particular direction. The stem shield 136 also protects the valve stem bearing 106 and the valve stem 36 from contamination. In FIG. 3, the stem shield has ends 137 that are bent up into the passageway 140 to further restrict the flow of contaminants.

The valve stem bearing 106 has a generally vertical portion 142 and a generally horizontal portion 144. The generally vertical portion 142 passes through the valve stem opening 104 and contacts the annular surface 98 on one side and the valve stem 36 on its other side. The generally horizontal portion 144 contacts the gasket 134 on one side, the stem shield 136 on its other side, and the valve housing 14 around its periphery.

The sensor housing 16 includes a sensor plunger 146 which extends therefrom. The plunger 146 is designed to contact the closed upper end 37 of the hollow tube 35 which is secured within the bore 38 formed in the armature 30. The plunger 146 reciprocates upwardly and downwardly as the armature 30 and the valve stem 36 travel within the motor housing 12 due to current changes in the wire windings 42. The sensor housing 16 transmits current to the wire windings 42 through the terminal 44 based on signals from an external computer. The sensor housing 16 may be any commercially available sensor.

In operation, the EGR valve 10 receives exhaust gases from the engine exhaust transferred by the exhaust inlet passage 116 through the valve opening 118. The exhaust gas that passes through the valve opening 118 is then passed into the gas chamber 122 within the valve housing 14. As signals are received by the sensor housing 16, which indicate certain engine conditions, the current in the bobbin 40 is either increased or decreased to vary the strength of the magnetic field. When engine conditions indicate that the valve opening 118 should be opened, the wire windings 42 are excited with current through the terminal 44. The increased current in the bobbin 40 increases the strength of the magnetic force and causes the armature 30 to move downwardly within the motor housing 12 causing the poppet 132 to move away from the valve seat 120 thus opening the valve opening 118.

As the armature 30 is moved downwardly, the armature bearing 66 keeps the armature 30 axially and radially aligned in the motor housing 12. As the armature 30 moves downward, the valve stem 36, which is secured within the armature bore 38, also moves downwardly. During the downstroke, the valve stem 36 contacts the valve stem bearing 106. The valve stem 36 is illustrated in a closed position in FIG. 1 and in an open position in FIG. 2. The exhaust gas that passes to the gas chamber 122 then exits through the exhaust passage 126 to the intake system of a spark ignition internal combustion engine.

The sensor housing 16 is provided with the proper amount of current to allow the desired amount of exhaust gas through the valve opening 118 and back to the engine. The sensor housing 16 allows for closed loop control between the valve stem 36 and an associated ECU. This amount is predetermined depending upon the load and speed of the engine as is well known in the art. The sensor located within the sensor housing 16 also provides closed-loop feedback to assist in determining the position of the valve stem 36 and to regulate the amount of exhaust gas that flows through the valve opening 118. Upon transfer of the desired amount of exhaust gas through the valve 10 back to the engine, the current transmitted through the terminal 44 to the wire windings 42 decreases. The magnetic force is thus decreased allowing the armature 30 to return to its initial position by the biasing spring 84.

As the armature 30 and the valve stem 36 travel upwardly, the valve poppet 132 re-engages the valve seat 120 and closes off the flow of exhaust gas through the valve opening 118. As the valve stem 36 travels upwardly, the valve stem bearing 106 guides the valve stem 36 and keeps it accurately aligned to ensure proper closure of the valve opening 118. At the same time, the plunger 146 moves upwardly by the hollow tube 35 with which it is in contact to provide an indication of the position of the valve stem 36 with respect to the valve seat 120. Metering and controlling of the exhaust passage in this manner helps in reducing the engine's emissions of harmful oxides of nitrogen.

The engine mount 18 is preferably mounted to the engine block through a plurality of mount holes 148 by fasteners, such as bolts or the like. As shown in FIG. 1, in one embodiment, the engine mount 18 is attached to or incorporated into the valve housing 14. In another preferred embodiment, shown in FIG. 3, the engine mount 18 is incorporated into or otherwise attached to the motor housing 12. The embodiment shown in FIG. 3 allows the valve housing 12 to be further consolidated, therefore decreasing the size of the valve and reducing the cost of manufacture. It should be understood that various other configurations and attachment points may be incorporated into the engine mount 18.

Figure 5:
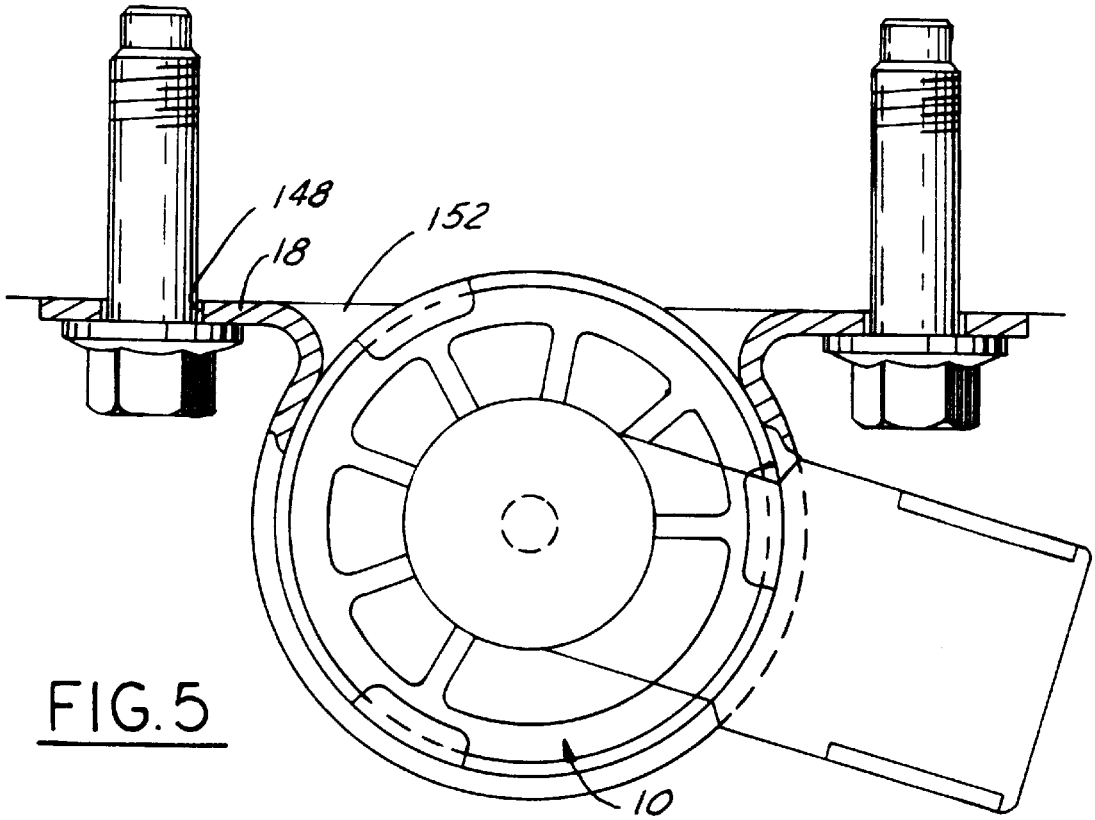
FIG. 5 is a top view illustrating the attachment of an exhaust gas recirculation valve to an engine in accordance with a preferred embodiment of the present invention.
Figure 6:
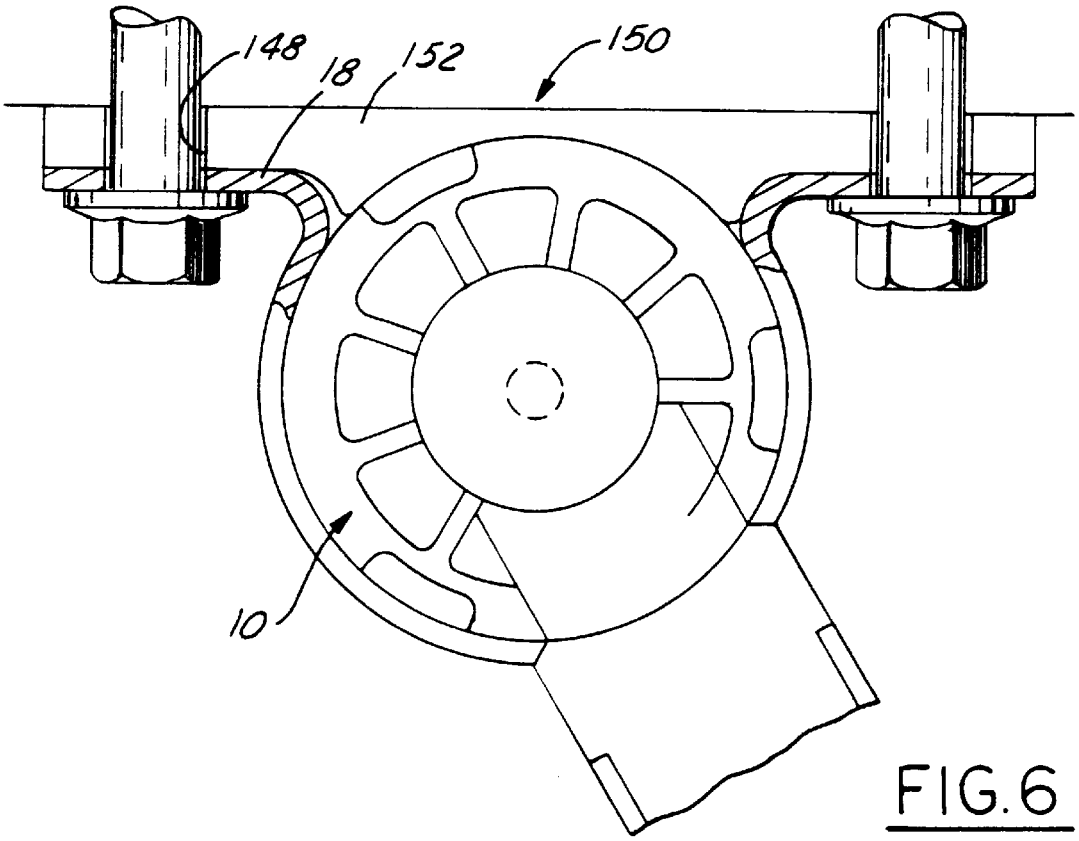
FIG. 6 is a top view illustrating the attachment of an exhaust gas recirculation valve to an engine in accordance with another preferred embodiment of the present invention.

As shown in FIGS. 5 and 6, the valve 10 may be attached through port holes 148 to the engine casting 150 in a variety of ways. In the embodiment shown in FIG. 5, the valve 10 is nested directly into the engine casting 150 which allows for the transfer of heat from the valve 10 into the engine casting 150. The engine casting 150 therefore acts as a heat sink. Additionally, the nesting of the valve 10 in this manner assists in reducing vibration. As shown, the engine mount 18 is used to secure the valve 10 and its components to the engine casting 150. In the embodiment shown in FIG. 6, an auxiliary spacer 152 is provided which is for use with a flat engine mount. The auxiliary spacer 152 is placed between the valve 10 and the engine mount 18 such that the bolts will pass through the engine mount 18, the spacer 152, and into the engine casting 150. In this embodiment, the engine mount 18 contacts the outer can 20 and the valve housing 14 to allow for heat transfer through the spacer 152 and into the engine casting 150. The auxiliary spacer 152 also helps minimize vibration.

Additionally, a bracket tab 154 is disposed below the outer can 20. The bracket tab 154 fits into a cut-out formed in the gasket 134 and engages a notch 156 cast into the valve housing 14, thus preventing the valve 10 from moving axially or radially relative to the bracket tab 154. The bracket tab 154 also improves the heat conduction from the valve to the gasket 134 thus minimizing any heat transfer to the motor housing 12.

Figure 4:
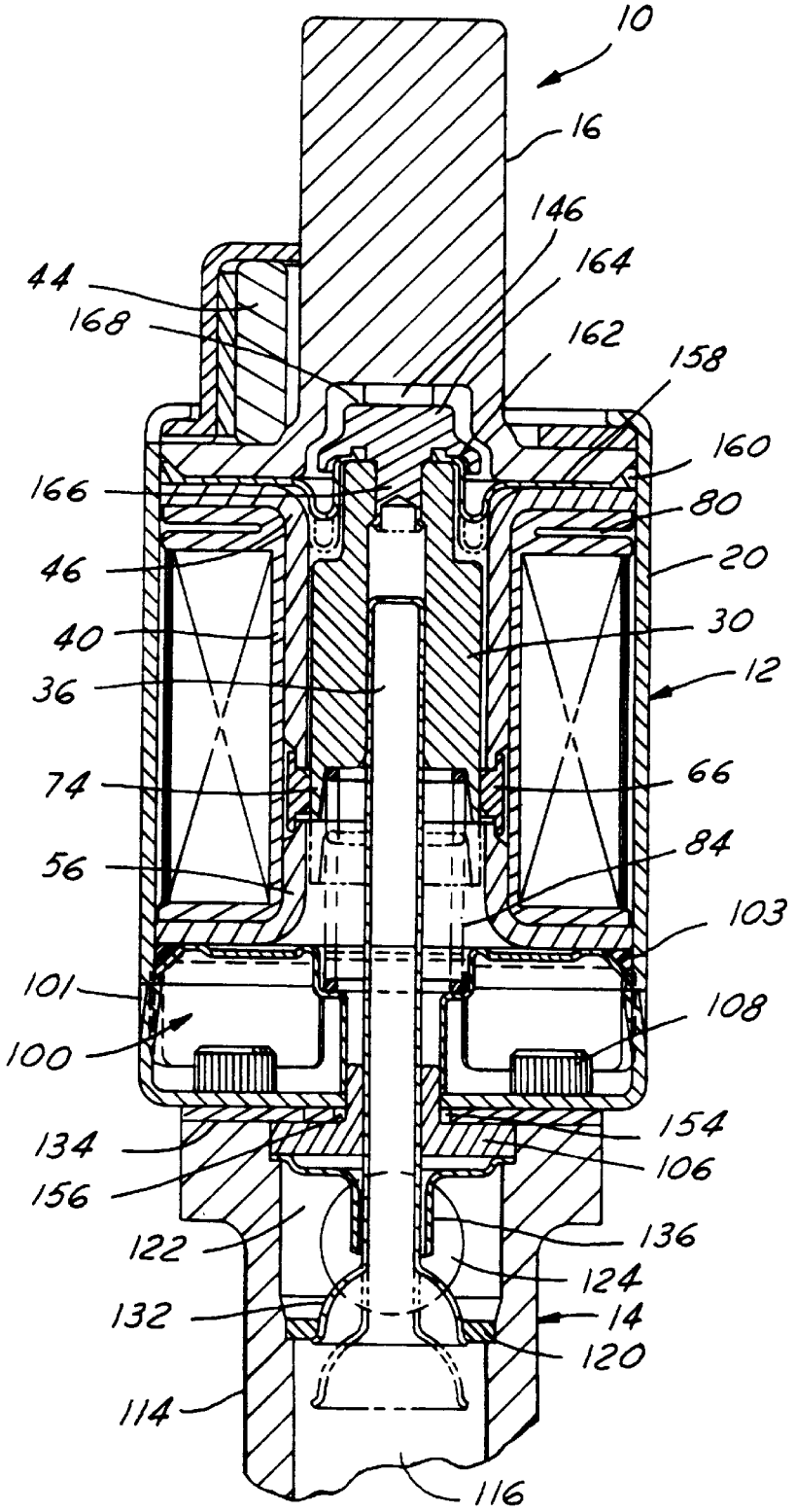
FIG. 4 is a cross-sectional view of an exhaust gas recirculation valve having a diaphragm in accordance with another preferred embodiment of the present invention.

As shown in FIG. 4, an alternative embodiment of the preferred EGR valve is disclosed. The valve 10 includes a motor housing 12 and a valve housing 14. The structure of the valve housing 14 is the same as in the prior embodiments, while the structure of the motor housing 12 is generally the same except that a diaphragm 158 is disposed between the motor housing 12 and the sensor housing 16. Specifically, a diaphragm 158 is captured between the flux return 46 and the sensor housing 16. The diaphragm 158 has an outer periphery 160 that is positioned in a similar location as the upper seal 28 in the prior embodiments. The diaphragm 158 has an inner periphery 162 which is secured to the top surface 32 of the armature 30 by an end cap 164. The end cap 164 has a protrusion 166 which extends into the bore 38 of the armature 30 thus securing it thereto. The end cap 164 is in communication with the plunger 146 at a top surface 168 to provide the same control over the armature 30 and the valve stem 36, as described above. The armature 30 has a different configuration for its top surface 32 so as to engage the end cap 164. The diaphragm 158 acts as a seal between the motor housing 12 and the sensor housing 16. The diaphragm 158 seals the connection between the motor housing 12 and the sensor housing 16 from the atmosphere and also provides improved vibration characteristics.

Having now fully described the invention, it will be apparent to one of ordinary skill in the art that many changes and modifications can be made thereto without departing from the spirit or scope of the invention as set forth herein.

What is claimed is:

1. An exhaust gas recirculation valve for an engine, comprising:

an engine mount for attaching said valve to said engine;

a valve housing, including a valve inlet adapted to receive exhaust gas, a valve seat surrounding a valve opening, through which said received exhaust gas passes, and a valve outlet adapted to communicate said received exhaust gas to an engine intake;

a motor housing having disposed therein a solenoid coil, an armature, and a valve stem in communication with said armature and linearly moveable so as to open and close the communication between said valve inlet and said engine intake;

a sensor housing having an electromagnetic mechanism therein to monitor the position of said valve stem and thus said armature;

a guide bearing disposed within said motor housing and engageable with an outside surface of said armature to accurately position said armature concentrically within said motor housing; and a valve stem bearing to assist in accurately closing a valve poppet, positioned on said valve stem, in said valve seat to prevent further communication between said valve inlet and said engine intake.

2. The valve of claim 1, further comprising a computer in communication with said valve, said computer providing signals to provide increased current to said solenoid coil depending upon engine conditions to move said armature and said valve stem within said motor housing.

3. The valve of claim 1, further comprising a stem shield surrounding said valve stem to prevent dirt and other contaminants from entering the motor housing.

4. The valve of claim 1, further comprising an annular cavity formed in a can between said motor housing and said valve housing.

5. The valve of claim 1, wherein a plurality of vent holes are formed in said annular cavity to allow air to circulate between said valve housing and said motor housing and to prevent the transfer of heat therebetween.

6. The valve of claim 1, wherein said armature bearing is positioned within said motor housing between a flux return and a pole piece within magnetic flux path.

7. The value of claim 1, wherein said valve is sealed from the atmosphere in that it does not have any external leakpaths.

8. The valve of claim 1, further comprising a biasing spring disposed within said motor housing and having a top portion in communication with a bottom surface of said armature for biasing said armature upward to return said valve stem into contact with said valve seat.

9. The valve of claim 8, wherein said biasing spring has a bottom portion in communication with a stamped part to support said biasing spring thereon.

10. The valve of claim 9, wherein said stamped part helps support said solenoid coil in said motor housing.

11. An exhaust gas recirculation valve, comprising:

a motor housing including, a bobbin, an armature having a bore formed therein, and a valve stem, said valve stem secured within said bore;

a valve housing including a valve inlet adapted to receive exhaust gas, a valve seat, a valve poppet located at an end of said valve stem to engage and disengage said valve seat to open and close a valve opening, thereby allowing or preventing said exhaust gas to pass to an engine intake;

a sensor housing, including a plunger extending therefrom into said motor housing, said plunger in communication with said valve stem to monitor the position thereof; and an armature bearing that is positioned within said motor housing and is in communication with an outer surface of said armature to position said valve stem as said valve opening is being exposed and wherein said armature bearing is positioned within said motor housing between a flux return and a pole piece.

12. The valve of claim 11, further comprising is a valve stem bearing that is positioned in an opening between said motor housing and said valve housing and contacts said valve stem only as it moves in response to movement of said armature.

13. The valve of claim 12, further comprising:

an engine mount for attaching said valve to a vehicle engine.

14. The valve of claim 13, further comprising a stem shield positioned in said valve housing and around said valve stem to prevent dirt and other contaminants from passing through said opening between said motor housing and said valve housing.

15. The valve of claim 13, further comprising an annular cavity in said motor housing for receipt of air to cool said valve stem.

16. The valve of claim 15, wherein at least one vent opening is formed in said motor housing to allow air to flow into and out of said annular cavity.

17. An exhaust gas recirculation valve for accurately controlling the flow of engine exhaust gas to an engine intake, comprising:

an outer can portion defining a motor housing therein and having an opening formed in a bottom surface;

a sensor housing secured to said valve and disposed above said motor housing;

an armature disposed within said motor housing and in electromagnetic communication with a solenoid coil disposed therearound, said armature having a bore formed therein;

a valve housing disposed beneath said outer can portion, said valve housing including an exhaust gas inlet passage, a valve opening in communication with said exhaust gas inlet passage, a valve seat surrounding said valve opening, and an exhaust gas exit passage;

a flexible diaphragm disposed between said motor housing and said sensor housing said diaphragm having an outer periphery positioned at a junction defined by said outer can portion, said motor housing, and said sensor housing to prevent any leakpaths to atmosphere at said junction;

a valve stem having an upper portion and a lower portion, said upper portion fixed within said armature bore and said lower portion having a poppet formed thereon for communication with said valve seat, said valve stem passing through said opening in said outer can bottom surface; and a plunger extending from said sensor housing and in communication with said valve stem to monitor the position of said valve stem with respect to said valve seat.

18. The exhaust gas recirculation valve of claim 17, further comprising a valve stem shield in said valve housing and disposed around a portion of said valve stem.

19. The exhaust gas recirculation valve of claim 17, further comprising an engine mount to attach said valve to an engine.

20. The exhaust gas recirculation valve of claim 19, wherein a spacer is disposed between said valve and said engine when said valve is mounted to said engine.

21. The exhaust gas recirculation valve of claim 19, further comprising:

a flux return disposed around a portion of said solenoid coil.

22. The exhaust gas recirculation valve of claim 21, further comprising:

a pole piece disposed around another portion of said solenoid coil, said pole piece positioned below said flux return such that said pole piece and said flux return do not meet.

23. The exhaust gas recirculation valve of claim 22, wherein a gap is formed between said pole piece and said flux return.

24. The exhaust gas recirculation valve of claim 23, further comprising a bearing positioned within said gap, said bearing having an outwardly extending annular surface that contacts said armature to assist in accurately positioning said valve stem as said armature moves downwardly.

25. The exhaust gas recirculation valve of claim 24, wherein said armature further comprises an ear portion that is initially aligned with a top surface of said pole piece.

26. The exhaust gas recirculation valve of claim 25, further comprising a hollow tube secured within said armature bore, said hollow tube having a closed top surface in communication with said plunger and an open bottom for receiving said valve stem therein.

27. The exhaust gas recirculation valve of claim 26, wherein said closed top surface is positioned above a top surface of said armature.

28. An exhaust gas recirculation valve for accurately controlling the flow of engine exhaust gas to an engine intake, comprising:

an outer can portion defining a motor housing therein and having an opening formed in a bottom surface;

a sensor housing secured to said valve and disposed above said motor housing;

an armature disposed within said motor housing and in electromagnetic communication with a solenoid coil disposed therearound, said armature having a bore formed therein;

a valve housing disposed beneath said outer can portion, said valve housing including an exhaust gas inlet passage, a valve opening in communication with said exhaust gas inlet passage, a valve seat surrounding said valve opening, and an exhaust gas exit passage;

a seal positioned at a junction between said outer can portion, said motor housing, and said sensor housing to prevent any leakpaths to atmosphere at said junction;

a valve stem having an upper portion and a lower portion, said upper portion fixed within said armature bore and said lower portion having a poppet formed thereon for communication with said valve seat, said valve stem passing through said opening in said outer can bottom surface; and a plunger extending from said sensor housing and in communication with said valve stem to monitor the position of said valve stem with respect to said valve seat.

29. An exhaust gas recirculation valve for accurately controlling the flow of engine exhaust gas to an engine intake, comprising:

an outer can portion defining a motor housing therein and having an opening formed in a bottom surface;

a sensor housing secured to said valve and disposed above said motor housing;

an armature disposed within said motor housing and in electromagnetic communication with a solenoid coil disposed therearound, said armature having a bore formed therein;

a valve housing disposed beneath said outer can portion, said valve housing including an exhaust gas inlet passage, a valve opening in communication with said exhaust gas inlet passage, a valve seat surrounding said valve opening, and an exhaust gas exit passage;

a valve stem having an upper portion and a lower portion, said upper portion fixed within said armature bore and said lower portion having a poppet formed thereon for communication with said valve seat, said valve stem passing through said opening in said outer can bottom surface;

a plunger extending from said sensor housing and in communication with said valve stem to monitor the position of said valve stem with respect to said valve seat; and a pole piece disposed around another portion of said solenoid coil, said pole piece positioned below said flux return such that said pole piece and said flux return do not meet such that a gap is formed between said pole piece and said flux return;

wherein said motor housing further comprises a partition member positioned below said solenoid coil and in contact with said sprig to support said solenoid coil in said motor housing;

wherein said pole piece, said partition member, and said outer can portion meet at a junction and wherein a seal is positioned at said junction to prevent any leakpaths to atmosphere.

30. The exhaust gas recirculation valve of claim 29, wherein an annular cavity is formed in said motor housing by said partition member.

31. The exhaust gas recirculation valve of claim 30, wherein at least one vent opening is formed in said can to allow air to flow into and out of said annular cavity from atmosphere.

32. The exhaust gas recirculation valve of claim 31, further comprising a gasket positioned between said outer can and said valve housing to prevent the transfer of heat between said housings.

33. An exhaust gas recirculation valve for accurately controlling the flow of engine exhaust gas to an engine intake, comprising:

a motor portion, including an outer can portion, a solenoid coil disposed within said outer can portion, and an armature in electromagnetic communication with said solenoid coil;

a valve housing including an exhaust gas inlet passage, a valve opening in communication with said exhaust gas inlet passage. a valve seat surrounding said valve opening, and an exhaust gas exit passage;

a valve stem extending between said motor housing and said valve housing and having an upper portion secured to said armature and a lower portion in communication with said valve opening;

a sensor housing secured to said valve and in communication with said motor housing to monitor the position of said valve stem with respect to said valve seat; and an annular cavity formed in said motor housing to prevent heat from said valve housing from transforming to said motor housing;

an armature bearing that is positioned within said motor housing and is in communication with an outer surface of said armature to position said valve stem as said valve opening is being exposed and wherein said armature bearing is positioned within said motor housing between a flux return and a pole piece.

34. The valve of claim 33, further comprising:

at least one vent opening formed in said can to allow air to flow from atmosphere into and out of said annular cavity.

35. The valve of claim 33, wherein said sensor housing monitors the position of said valve stem by a plunger extending from said sensor housing that reciprocates in response to movement of said valve stem.

36. The valve of claim 33 wherein said valve is nested directly into an engine casting to minimize vibration and allow for heat transfer from the valve to said casting.

37. The valve of claim 33, further comprising an annular bearing positioned within said motor housing to contact said armature and keep said armature aligned as said valve stem moves linearly with respect to said motor housing.

38. The valve of claim 37, further comprising a valve stem bearing designed to contact said valve stem as said valve opening is being closed to assist in properly aligning a valve poppet formed on said lower portion of said valve stem with respect to said valve seat.

39. The valve of claim 34, wherein said annular cavity is defined between a partition and said outer can.

40. The valve of claim 39, wherein a plurality of sheer tabs are formed in said outer can around said annular cavity to support said partition.

41. The valve of claim 40, wherein said partition supports said solenoid coil and thus said sheer tabs support said solenoid coil.

* * * * *